United States Patent [19]

Schriber et al.

[11] 4,155,027

[45] May 15, 1979

[54] S-BAND STANDING WAVE ACCELERATOR STRUCTURE WITH ON-AXIS COUPLERS

[75] Inventors: Stanley O. Schriber; Samuel B. Hodge; L. Warren Funk, all of Deep River, Canada

[73] Assignee: Atomic Energy of Canada Limited, Ottawa, Canada

[21] Appl. No.: 842,296

[22] Filed: Oct. 14, 1977

[30] Foreign Application Priority Data

May 9, 1977 [CA] Canada ..... 277939

[51] Int. Cl.[2] ..... H01J 25/10

[52] U.S. Cl. ..... 315/5.41; 315/3.6; 315/5.42

[58] Field of Search ..... 315/3.6, 5.41, 5.42

[56] References Cited

U.S. PATENT DOCUMENTS

| | | | |
|---|---|---|---|
| 3,153,767 | 10/1964 | Kyhl | 315/5.42 X |
| 3,233,139 | 2/1966 | Chodorow | 315/3.5 |
| 3,274,428 | 9/1966 | Harris | 315/3.6 |
| 3,668,459 | 6/1972 | Symons et al. | 315/3.6 |
| 3,906,300 | 9/1975 | Tran | 315/5.42 |
| 3,953,758 | 4/1976 | Tran | 315/5.41 |
| 4,004,181 | 1/1977 | Kervizic et al. | 315/5.41 |
| 4,024,426 | 5/1977 | Vaguine | 315/5.41 |

*Primary Examiner*—Saxfield Chatmon, Jr.
*Attorney, Agent, or Firm*—Edward Rymek

[57] ABSTRACT

An S-band standing wave electron accelerator structure having a multiplicity of resonant accelerating cavities and resonant coupling cavities mounted sequentially in an alternating accelerating cavity-coupling cavity pattern along an accelerator axis, with adjacent cavities separated by a common wall. The common walls and end walls of the structure have beam holes concentric with the axis, and the common walls further have two slots for coupling energy between the cavities. To prevent direct coupling between the accelerating cavities which are separated by a coupling cavity, the coupling slots in one wall of the coupling cavity are rotated approximately 90° about the accelerator axis with respect to the coupling slos in the other wall. The structure is assembled by brazing a number of conductive segments together. Each segment forms half of each of the adjacent cavities having the common wall and thus consists of half of an accelerating cavity and half of a coupling cavity. The outer profile of the segments may be circular, square, or hexagon. The cooling system is simplified if a combination of circular and square segments, or only hexagonal segments are used.

9 Claims, 7 Drawing Figures

S-BAND STANDING WAVE ACCELERATOR STRUCTURE WITH ON-AXIS COUPLERS

BACKGROUND OF THE INVENTION

This invention is directed to a standing wave charged particle accelerator structure and in particular to an S-band standing wave electron accelerator structure assembled from similar basic components having on-axis coupling cavities.

The need for high efficiency rf accelerating structure operating at room temperature has been fulfilled for certain applications by standing-wave coupled-cavity accelerators, the side-coupled structure described in U.S. Pat. No. 3,546,524 which issued to P. G. Stark on Dec. 8, 1970, being an example. Considerable work has been carried out with respect to side-coupled structures as it has been felt that these structures have the highest possible shunt impedance. Recent measurements have shown that a structure using on-axis coupling cavities has a higher shunt impedance than an equivalent side-coupled structure.

Even though, as with these accelerating structures, the on-axis coupled structure necessarily includes a vacuum tight system with cavity shapes, cooling, and dimensional tolerances determined from constraints associated with desired rf and accelerating properties, its ease of assembly and high efficiency of converting rf power into beam power make it an attractive alternative to the other structures.

U.S. Pat. No. 3,953,758 which issued to Duc Tien Tran on Apr. 27, 1976, described a linear accelerating structure having on-axis coupling. On-axis coupled structures are found to be deficient in that non-axially symmetric modes propagate along the accelerator structure by the coupling slots between the cavities. In addition, cooling systems for the structure are inefficient in that they are not integrated into the structure.

SUMMARY OF THE INVENTION

It is therefore an object of this invention to provide an S-band standing wave on-axis coupled electron accelerator structure having a high shunt impedance.

It is a further object of this invention to provide an on-axis coupled electron accelerator structure in which coupling is arranged to improve rf properties and to prevent propagation of non-axially symmetric modes.

It is another object of this invention to provide a standing-wave on-axis coupled electron accelerator structure which is easy to tune and assemble.

It is a further object of this invention to provide an on-axis coupled electron accelerator structure having a simple and effective cooling arrangement.

These and other objects are achieved in a standing wave charged particle accelerator structure having a multiplicity of resonant accelerating and resonant coupling cavities mounted sequentially and alternately along a common accelerator axis, adjacent cavities being separated by a common wall. The first and the last cavity end walls and the common walls include openings concentric with the accelerator axis to provide a charged particle beam path through the structure. Each of the common walls further include two energy coupling slots located about the accelerator axis. The coupling slots located in one common wall of each coupling cavity are rotated approximately 90° about the accelerator axis with respect to the coupling slots in the other common wall of the coupling cavity to reduce propagation of non-axially symmetric modes.

In accordance with one aspect of the invention, the accelerator structure is assembled from a number of conductive segments, each segment having half of an accelerating cavity and half of a coupling cavity joined by the common wall. Each segment may be made of oxygen free high conductivity copper with its outer profile being circular, square or hexagonal.

In accordance with another aspect of this invention, the outer profile of alternate segments in the structure are circular centered about the accelerator axis and the remaining segments are square centered about the accelerator axis, one or more of the corners in the square segments include holes through which cooling tubes are located parallel to the structure.

In accordance with another aspect of this invention, the outer profile of the segments is hexagonal, the diagonal corners of alternate segments protrude from the accelerator structure and diagonal corners of the remaining segments protrude from the accelerator structure at an angle of 90° from the alternate segment diagonal corners. A first and a second cooling tube are located in holes in the protruding corners of the alternate segments, and a third and a fourth cooling tube are located in holes in the protruding corners of the remaining segments to provide effective cooling.

DESCRIPTION OF THE PREFERRED EMBODIMENT

An on-axis coupled linear electron accelerator structure consists of a series of resonant accelerating cavities in which a standing wave field is established for accelerating an electron beam. The structure also includes resonant coupling cavities interleaved between the accelerating cavities, i.e. the accelerator structure has a coupling cavity between each adjacent pair of accelerating cavities. Thus, a coupling cavity is positioned at each null in the amplitude of the standing wave pattern. This is referred to as operation in the $\pi/2$ mode.

Figures 1, 2, 3, 4:
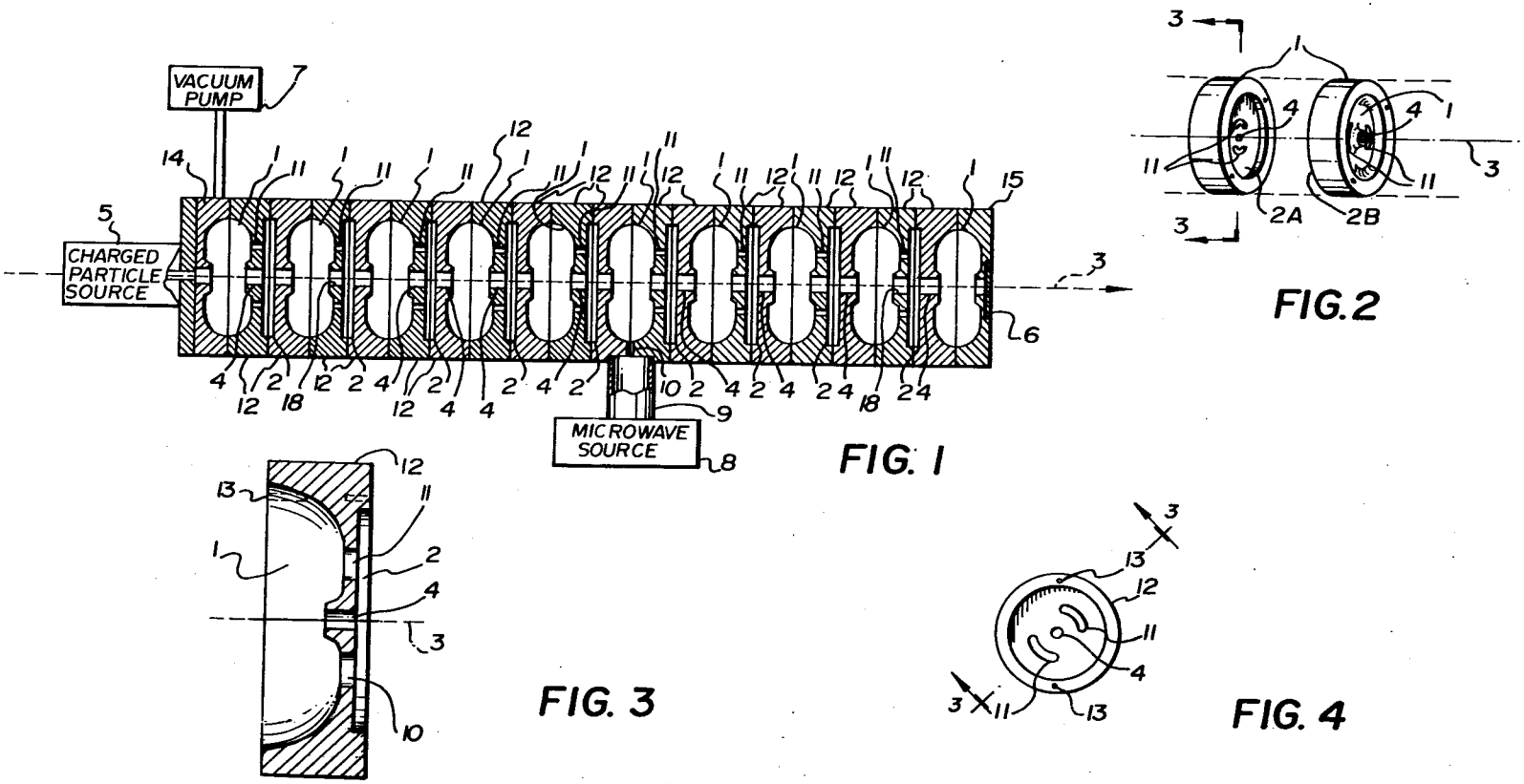
FIG. 1 is a cross-section of one embodiment of the charged particle accelerator structure in accordance with this invention.
FIG. 2 is an exploded view of two segments of the structure which form a coupling cavity.
FIG. 3 is cross-section view of a basic segment of the structure.
FIG. 4 is a front view of a circular outer profile segment.

The accelerator structure for $\pi/2$ mode of operation as illustrated in FIG. 1, consists of a series of accelerating cavities 1 interleaved by coupling cavities 2 with the cavities 1 and 2 positioned symmetrically about an accelerator axis 3. Beam holes or openings 4 between the coupling cavities 2 and the accelerating cavities 1 are located on the axis 3 to allow a beam of electrons, generated by the electron source 5, to enter the accelerator structure and to move along the length of the structure. The structure is terminated by a window 6 or some other suitable vacuum integrity which is established by a vacuum pump 7. The structure is energized by a microwave source 8 coupled to one of the accelerating cavities 1 via a waveguide 9 and an iris 10, and the standing wave field is established throughout the length of the accelerator by the coupling cavities 2 which are coupled to adjacent accelerating cavities by coupling slots 11.

To eliminate direct coupling between adjacent accelerating cavities 1 separated by coupling cavities 2, the two slots 11 shown in FIG. 2 on one wall of the coupling cavity 2 between the accelerating cavities 1 are rotated with respect to the slots 11 on the opposite wall of the coupling cavity 2. This results in improved rf properties and reduced propagation of non-axially symmetric mode such as the $TM_{110}$-mode, which can lead to beam break-up effects. To assure the elimination of direct coupling between adjacent accelerating cavities 1, the two slots 11 in one cavity 2 wall are preferably rotated approximately 90° with respect to the two coupling slots in the opposite cavity 2 wall. The two slot system is shown in FIG. 2 wherein an exploded view of two segments 12 which form one coupling cavity 2, is illustrated. Slots 11 on section 2A of cavity 2 are rotated 90° with respect to the slots 11 in section 2B.

To facilitate the assembly of an accelerator structure in accordance with the present invention, the structure may consist of a multiplicity of similar segments 12 shown in a side view in FIG. 3 wherein the cavity profiles and openings are shown in dotted lines. Segments 12 are preferably fabricated from oxygen free high conductivity copper. This material is desirable because of its low vacuum outgassing rate, machineability, reasonable cost and amenability to brazing in a hydrogen atmosphere either to itself or to stainless steel forming good vacuum joints particularly when the segments are forged from rolled plate or bar and then machined. In particular, it has been determined that the brazing process may be carried out with 50 Au - 50 Cu alloy, however that 72 Ag - 28 Cu alloy is preferred.

Each segment 12 includes one-half of the accelerating cavity 1, one-half of the coupling cavity 2, two coupling slots 11, and the beam hole 4, all of which are symmetrically located about the axis 3. In addition, dowel holes 13 are precisely located on the segments to facilitate assembly.

Cavity resonant frequencies are determined by geometrical dimensions, particularly the length of the drift tube or beam hole nose 18, cavity diameters and parallelism of the coupling cavity faces. The coupling cavity 2 walls may be flat and the diameter of the coupling cavities 2 may be smaller than the diameter of the accelerating cavities 1. In the case of a 3 GHz accelerator structure, a tuning tolerance of ±500 kHz for both the accelerating cavities 1 and coupling cavities 2, with a maximum 500 kHz passband gap establishes the tolerances for these critical dimensions. Thus tolerances of ±5 μm for the nose 18 length and coupling cavity face parallelism across any diameter and ±13 μm for the accelerating cavity 1 and coupling cavity 2 diameters is required for a 3 GHz accelerator structure.

Uniformity of a 3 GHz accelerating cavity profile from segment 12 to segment 12 may be ensured by machining the cavity outer diameter to a tolerance of ±5 μm and machining the profile using a "Mimik Tracer" located with respect to this diameter.

Rf field levels from coupling constant differences may be held to within 10% over the entire accelerator structure by requiring coupling differences to be less than 1%. This requires machining tolerances for the slots 11 of ±13 μm in radius and width, and of +0°, −0.25° in azimuth. Coupling constant uniformity may be ensured by the use of a milling jig located with respect to the drift tube hole. The segments 14, 15 at each end of the accelerator structure (FIG. 1) are similar to the segments 12 except that they do not include the coupling slots 11. In addition, the segment 14 at the input end can be connected to the electron source 5 and the vacuum pump 7 whereas the segment 15 at the output can be connected to a window 6 or other suitable vacuum component.

Figure 5:
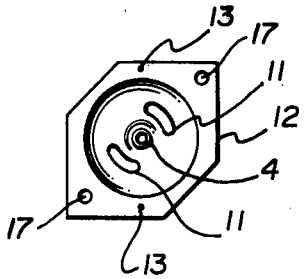
FIG. 5 is a front view of a hexagonal outer profile segment.

The outer profiles of the segments 12, 14 and 15 may have various shapes such as round as shown in FIG. 4, however to facilitate cooling of the structure as well as to facilitate alignment and mounting of the completed accelerating structure, a square or the hexagonal outer profile shown in FIG. 5 is preferred.

Figure 6:
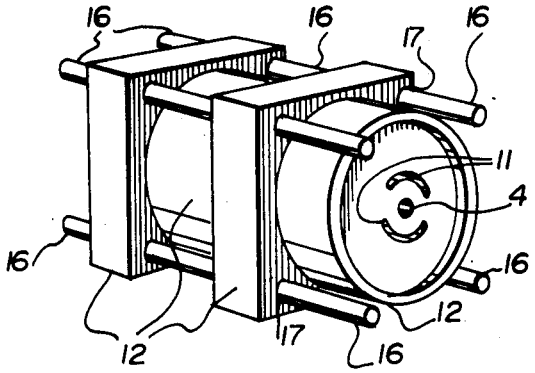
FIG. 6 illustrates the cooling system in a circular-square segment structure.

In an accelerating structure which includes only round outer profile segments, it is necessary to braze longitudinal cooling tubes on its outer surface if coolant-vacuum interfaces are to be eliminated. If square and round outer profile segments 12 are arranged alternately as shown in FIG. 6, longitudinal cooling tubes 16 may be located in holes 17 through the corners of each square segment where they are brazed to provide good thermal contact. Since the square and the round segments alternate, insertion of the tubes 16 is facilitated during assembly, and a uniform cooling system is achieved.

Figure 7:
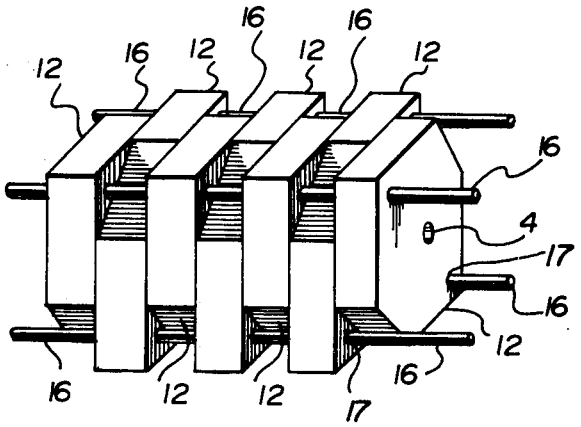
FIG. 7 illustrates the cooling system in a hexagonal segment structure.

The use of the hexagonal outer profile segments 12 shown in FIG. 5 however can achieve the same result as the round-square system described above, when the dowel holes are positioned at a 45° angle from the cooling holes 17. As shown in FIG. 7, when segments 12 are sequentially positioned back to back to form the accelerating cavities 1 and the coupling cavities 2, alternate segments have cooling holes aligned on diagonal corners of the structure in which cooling tubes 16 may be brazed.

We claim:

1. An S-band standing wave electron accelerator structure comprising:

a multiplicity of resonant accelerating and resonant coupling cavities mounted sequentially and alternately on a common accelerator axis, adjacent cavities being separated by a common wall, wherein the first and the last cavity end walls and said common walls include openings concentric with the accelerator axis to provide an electron beam path through said structure, and wherein each of said common walls include two energy coupling slots located about said accelerator axis, the coupling slots located in one common wall of each coupling cavity being rotated approximately 90° about the accelerator axis with respect to the coupling slots in the other common wall of the coupling cavity to reduce propagation of non-axially symmetric modes.

2. Apparatus as claimed in claim 1 wherein half of each of the adjacent cavities having the common wall are formed from a single conductive segment.

3. Apparatus as claimed in claim 2 wherein each segment consists of oxygen free high conductivity copper.

4. Apparatus as claimed in claim 2 wherein the outer profile of the segments is circular about the accelerator axis.

5. Apparatus as claimed in claim 2 wherein the outer profile of alternate segments are circular about the accelerator axis and the remaining segments are square about the accelerator axis.

6. Apparatus as claimed in claim 5 wherein one or more of the corners of the square segments includes a hole through the segment, a cooling tube being positioned parallel to the structure within the holes of sequential square segments.

7. Apparatus as claimed in claim 2 wherein the outer profile of each segment is hexagonal.

8. Apparatus as claimed in claim 7 wherein diagonal corners of alternate segments protrude from the accelerator structure and diagonal corners of the remaining segments protrude from the accelerator structure at an angle of 90° from the alternate segment diagonal corners.

9. Apparatus as claimed in claim 8 wherein a first and a second cooling tube traverse the alternate segments through holes in the protruding corners and a third and a fourth cooling tube traverse the remaining segments through holes in the protruding corners.

* * * * *